US008539807B2

(12) United States Patent
Dial et al.

(10) Patent No.: US 8,539,807 B2
(45) Date of Patent: Sep. 24, 2013

(54) PROCESS FOR MAKING UPSETS FOR OILFIELD DRILL PIPE

(75) Inventors: Kenneth Auburn Dial, Navasota, TX (US); Joe Douglas Toler, Navasota, TX (US)

(73) Assignee: National Oilwell Varco, L.P., Houston, TX (US)

( * ) Notice: Subject to any disclaimer, the term of this patent is extended or adjusted under 35 U.S.C. 154(b) by 876 days.

(21) Appl. No.: 12/539,758

(22) Filed: Aug. 12, 2009

(65) Prior Publication Data

US 2011/0036138 A1 Feb. 17, 2011

(51) Int. Cl.
*B21D 41/00* (2006.01)

(52) U.S. Cl.
USPC ..... 72/370.1; 72/316; 72/318; 72/370

(58) Field of Classification Search
USPC ..... 72/361, 419, 420, 421, 422, 342.1, 72/342.8, 342.94, 342.96, 364, 352, 358, 72/359, 370.1, 370.12, 370.13, 370.25, 370
See application file for complete search history.

(56) References Cited

U.S. PATENT DOCUMENTS

| | | | | |
|---|---|---|---|---|
| 3,807,077 | A * | 4/1974 | Deck et al. | 432/10 |
| 3,912,460 | A * | 10/1975 | McGann | 422/143 |
| 4,062,216 | A * | 12/1977 | Hanamoto et al. | 72/128 |
| 4,160,543 | A * | 7/1979 | Dill et al. | 266/252 |
| 4,845,972 | A * | 7/1989 | Takeuchi et al. | 72/370.03 |
| 5,184,495 | A * | 2/1993 | Chunn et al. | 72/318 |
| 5,468,444 | A * | 11/1995 | Yazaki et al. | 264/566 |
| 5,743,301 | A * | 4/1998 | Winship | 138/109 |
| 6,244,631 | B1 | 6/2001 | Payne et al. | 285/333 |
| 7,246,626 | B2 * | 7/2007 | Fife et al. | 134/102.1 |
| 8,049,587 | B2 * | 11/2011 | Israelsson Tampe et al. | 336/59 |
| 2005/0036879 | A1 * | 2/2005 | Jhaveri et al. | 414/751.1 |
| 2008/0276679 | A1 * | 11/2008 | Eckerstorfer et al. | 72/38 |

* cited by examiner

*Primary Examiner* — Dana Ross
*Assistant Examiner* — Homer Boyer
(74) *Attorney, Agent, or Firm* — The JL Salazar Law Firm; Jeffery E. Daly

(57) ABSTRACT

Pipe to be upset is conveyed via walking beam though a series of induction heating coils and one end is heated to a maximum temperature of 2350 degrees F. Thereafter, a robot transports the pipe into a forging machine where the pipe end is upset in one or more die pockets. For those types of pipes where the pipe end temperature falls below an acceptable temperature during upsetting, the robot delivers the pipe end to an auxiliary induction heating coil and is re-heated to an acceptable forging temperature. The robot then transports the pipe back into the forging machine where the pipe end is forged to its final upset dimensions.

9 Claims, 2 Drawing Sheets

PROCESS FOR MAKING UPSETS FOR OILFIELD DRILL PIPE

BACKGROUND OF THE INVENTION

1. Field of the Invention

This invention is drawn to the process for making oilfield drill pipe. In the process of making oilfield drill pipe one end of a cylindrical pipe is 'upset', that is made to a larger diameter and greater thickness than the original pipe. This allows for the pipe to be welded directly to an oilfield tool joint, as is well known and is shown, for example, in FIG. 1 of U.S. Pat. No. 6,244,631, incorporated by reference herein. During the upsetting process, one end of the pipe is preheated and then run through a forging process which increases both the outside diameter and the wall thickness of its end, while typically (but not always) reducing its inside diameter. This allows the upsetted end of the drill pipe to later be welded directly to the end of a tool joint which is then typically threaded in a later machining process. Most often, the upsetting process involves two or sometimes three stages of upsetting, and is typically performed at temperatures in the 2000 to 2350 degrees F. range. The process is then repeated to upset the other end of the drill pipe in a similar manner.

Pipe to be upset is staged upon one or more pipe racks on one side of the forging building and is run width-wise in a continuous process through the pre-heating and upsetting operations. The pipes are then delivered to the far side of the building for further processing. As stated earlier, the upsetting may be a two stage or a three stage process depending upon the type of pipe. Many of the sizes and types of pipes that require a three stage upsetting process cool rapidly during the upsetting process, making them too cool to be properly upset through the third phase of the upsetting without re-heating. In the past, for these types of pipe, the entire manufacturing process for upsetting the pipe would have to be re-tooled and/or reconfigured for the third upsetting, a re-tooling operation which could take 4-8 hours. Once the re-tooling was complete, the entire lot of partially upset pipes is transported around the building and run through the forging process (as described above) for a second time to perform only the third upsetting stage needed to complete the upsetting process. As a result of this present process, pipes requiring a third upsetting stage were generally required to make two full trips through the entire pipe upsetting process to upset just one end, and four full trips through to upset both ends.

2. Description of the Related Art

The present process in the manufacture of oilfield drill pipe is to produce a cylindrical thick-wall pipe of thirty feet or so in length which has tool joints welded on each end. Typically the metallurgy and chemistry of the pipe and tool joints are different, as the tool joint must be able to tolerate the repeated make up and break out of its threaded ends as the drill pipe is raised and/or lowered into a well bore. Since the diameter and thickness of the end of the tool joint are generally greater than that of the drill pipe, the end of the drill pipe are 'upset' in an upsetting process to make the inside and outside diameters of the ends of the drill pipe match those of the tool joint.

When upsetting the pipe ends, the preferred temperature range for forging is usually between about 2000 and 2350 degrees F. After the pipe end is heated to the correct temperature it is delivered to the upsetter where the pipe end is moved into a series of progressive die pockets in the upsetter and progressively shaped in a forging process designed to achieve the final inside and outside diameters of its end. Because time is elapsing after the pipe leaves its heat source, the temperature is decreasing. Also, the dies themselves tend to cool the pipe end. Due to mass, most sizes and type of pipe products are able to maintain enough heat to complete the forging process on the first run through. However, depending upon the initial and final dimensions of the pipes and other factors, the ends of some types of pipes will fall below acceptable forging temperature before the final forging dimensions are achieved. In these cases each pipe must again be transported though the entire process, re-heated and forged to final dimensions. It should be noted that not all types of pipe need to be re-heated and re-forged during the upsetting process. However, for those pipes that do need re-heating for the final forging operation, the entire lot of pipe is generally run through the heat and forge cycle twice for each end—or four times all together—disrupting the existing process flow and greatly reducing the efficiency.

Re-heating the end of the pipe inline would eliminate the necessity of transporting the pipe through the entire process a second time.

BRIEF SUMMARY OF THE INVENTION

Pipe is conveyed via a walking beam though one or more induction heating coils designed to heat one end of the pipe to forging temperature. At the final, or primary, induction heating coil the pipe end is heated to a maximum temperature of 2350 degrees F. The temperature is monitored and controlled via two infrared pyrometers. Upon reaching 2350 degrees F. the pipe end temperature is held for a minimum of 7 seconds. This allows for even heating throughout the heat affected zone. After the pipe end has been heated, a robot transports the pipe from the primary induction heating coil into the forging machine where the pipe end is upset in one or more die pockets in an upsetter. For those types of pipes where the pipe end temperature is known to fall below the acceptable temperature limits during or after the second upsetting, the robot will deliver the pipe end to an auxiliary induction heating coil stationed near the front of the upsetter, where the pipe is re-heated to an acceptable forging temperature. Because reheating the pipe may cause an unacceptable increase in temperature of the pipe adjacent to the upsetting region, an air cooling ring mounted on the auxiliary induction heating coil may be selectively operated to provide cooling to limit the temperature of the heat effected zone of the pipe. The robot then transports the pipe back into the final forging machine die pocket where the pipe end is forged to its final dimensions.

DETAILED DESCRIPTION OF THE INVENTION

Figure 1:
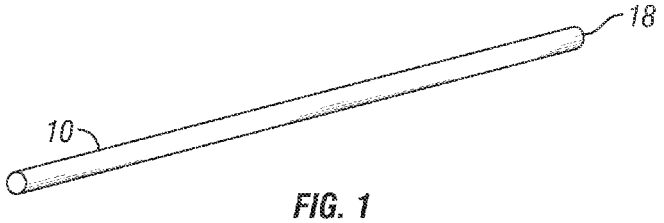
FIG. 1 is a perspective view of a drill pipe prior to the upsetting process.
Figure 2:
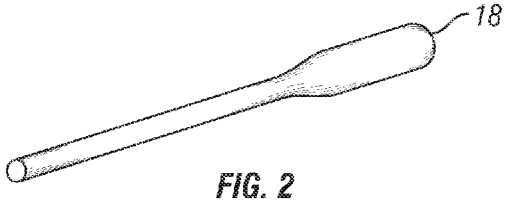
FIG. 2 is a perspective view of a drill pipe after the upsetting process
Figure 3A:
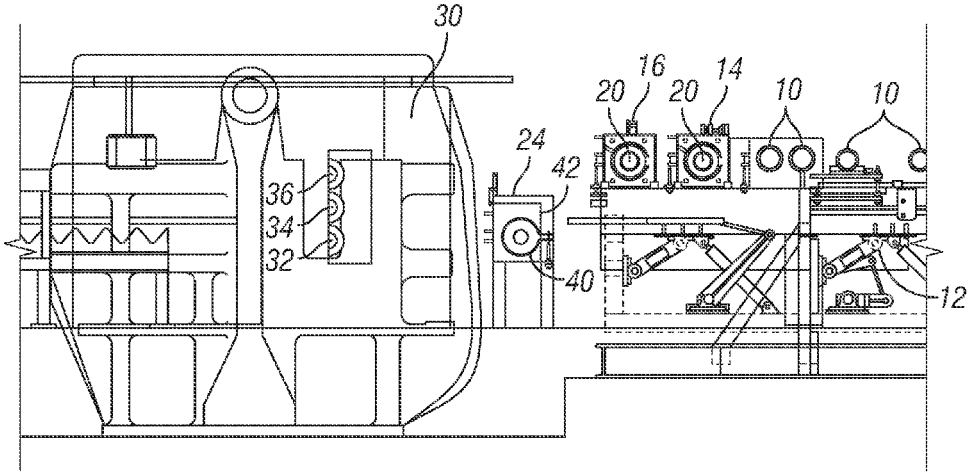
FIG. 3A is a line drawing of typical equipment used in an upsetting operation of the present invention, and illustrating the secondary heating coil.
Figure 3B:
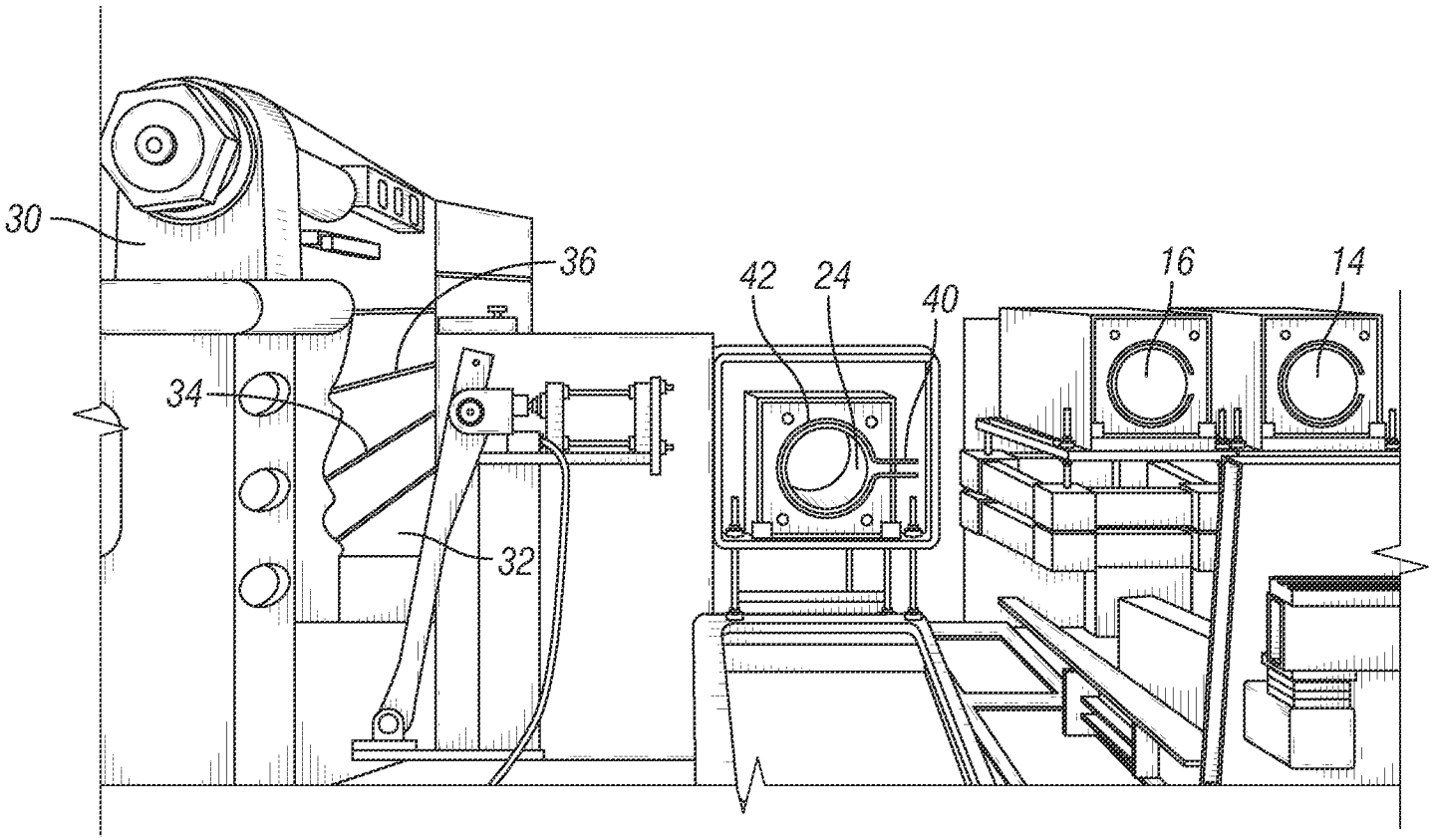
FIG. 3B is a perspective view of the upsetting operation equipment of FIG. 1.

Referring now to FIGS. 1, 2, 3A and 3B; in the present invention, drill pipe 10 to be 'upset' is conveyed via walking beam 12 placed a distance in front of one or more induction heating coil(s) 14, 16. A preliminary heating process made by induction heating coil 14 may heat the end 18 of the pipe 10 to a preliminary temperature of about 1800 F. This is done by moving the pipe end sequentially into the pair of induction heating coils 14, 16 such that center 20 of the coil 14 is positioned at around the end of the pipe and the pipe is within the induction coil 14. Power is applied to the heating coils 14, 16 and they induce an alternating current in the end 18 of the drill pipe 10, which generates heat and causes the temperature of the end 18 of the pipe 10 to rapidly increase. The pair of induction heaters coils 14, 16 are then retracted after each heating cycle, allowing the pipe 10 to advance and to align with the second induction heating coil 16. At the second and final induction heating coil 16 (called the primary coil) the pipe end 18 is heated to a maximum temperature of 2350 degrees F. while a second piece of pipe 10 may be preheated in the first induction heating coil 14 as previously described. By cycling the pair of induction heating coils 14, 16 in this manner a continuous process of heating the ends of the pipe 10 is possible.

The temperature of the pipe ends 18 is monitored and controlled via two infrared pyrometers (not shown). Upon reaching 2350 degrees in the second coil 16, the pipe end temperature is held for a minimum of 7 seconds. This allows for even heating throughout the zone. After the pipe has been heated, a robot (not shown) transports the pipe from the primary induction heating coil 16 into a type of forging machine known as an upsetter 30 where the pipe end is upset in each of (typically) three upsetter die pockets; upsetter pocket one 32, upsetter pocket two 34, and upsetter pocket three 36. For most pipes, the temperature of the pipe end 10 remains high enough to progress through all three upsetting operations without interruption. However, some types of pipe cool too rapidly during upsetting and require a re-heat before the third stage of upsetting.

For these types of pipes, the pipe end 18 temperature may fall below an acceptable temperature for upsetting after the second 34 stage of the upsetting process. In the prior art process, the pipes would then be re-run through the entire process a second time for the third upsetting—effectively doubling the time to process the pipe and also doubling the accompanying wear and tear on the pipe-handling machinery. However, in the process of the present invention, for those pipes needing re-heating, the robot program will automatically deliver the pipe end 18 of these pipes to an additional auxiliary induction heating coil 24 stationed near the front of the upsetter 30. The auxiliary induction heating coil 24 then re-heats the pipe end 18 to an acceptable forging temperature for the third upsetting stage.

In order to prevent the non-upset area of the pipe immediately adjacent to the upset from getting too hot from the thermal conduction of the heat away from the induction heated upset portion of the pipe, a semi-circular air manifold 40 having a plurality of air orifices (not shown) spaced about its ID is pressurized with compressed air. The manifold 40 is mounted on the face 42 of the auxiliary induction heating coil 24, and the air orifices spaced around the inside diameter of the manifold 40 deliver a flow of cooling air to the non-upset area of the pipe immediately to the auxiliary induction heating coil 24. When the auxiliary induction heating coil 24 is energized, the airflow to the manifold 40 is activated, and the pipe end 18 is re-heated. The robot then transports the pipe back into the forging machine final die pocket (or pockets) where the pipe end is forged to its final dimensions.

In the prior art upsetting processes, the pipe products 10 that required a re-heating before the third upsetting operation would have to have each end run through the process for the first two upsetting stages as described, and then each end would be re-run through the entire process a second time for the third upsetting. As would be appreciated by those skilled in the art, the new process described herein greatly improves the efficiency and throughput of the pipe end 18 upsetting process by eliminating the need to run each end of the same pipe through the process two times.

Product flow of the new process, for pipe that need re their ends re-heated between the second and third upsetting operations of the present invention is as follows:

A. Pipe is pre-heated inside coil (14)

B. Pipe is walked to final, primary coil (16)

C Pipe is brought to forging temperature—2350° F. max in primary coil (16)

D. Pipe is picked from primary coil (16) position via gantry robot

E. Pipe is transported to the Upsetter position 1 (32)

F. The Upsetter is cycled

G. Pipe is transported to Upsetter position 2 (34)

H. The Upsetter is cycled

I. Pipe is transported to the reheat coil (24) located between the Upsetter (30) and primary coil (16)

J. Pipe is reheated to a pre-programmed forging temperature

K. Pipe is transported to Upsetter position 3 (36)

L. The Upsetter is cycled

M. Pipe is delivered downstream

Cycle Repeats

If overheat is detected during reheat cycle in the reheat coil

Alarm is to be generated

Pipe is to be transported to overheat rack where it is identified as needing to have the overheated end cut off Whereas the present invention has been described in particular relation to the drawings attached hereto, it should be understood that other and further modifications apart from those shown or suggested herein, may be made within the scope and spirit of the present invention.

What is claimed is:

1. A manufacturing process for forming upsets on ends of drill pipe for those types of drill pipe requiring re-heating between second and third upsetting stages, comprising:

operating a first preheat coil to preheat a pipe end of the drill pipe to be upset in a first preheat coil;

walking the drill pipe to a second, primary heating coil;

bringing the pipe end to a forging temperature of 2350 ° F. max in the primary heating coil;

picking up the drill pipe from the primary heating coil position via a gantry robot;

transporting the drill pipe to a first position of a pipe upsetter device and inserting the pipe end into the first position of the pipe upsetter device;

cycling the upsetter device on the end of the drill pipe a first time;

transporting the pipe to a second position of the pipe upsetter device and inserting the pipe end into the second position of the pipe upsetter device;

cycling the pipe upsetter device on the pipe end a second time;

transferring the drill pipe to a reheat coil located between the pipe upsetter device and the primary heating coil;

re-heating the drill pipe end to the forging temperature in the reheat coil;

transporting the drill pipe to a third position of the upsetter device;

cycling the pipe upsetter device a final time; and delivering the drill pipe for downstream operations.

2. The process of claim 1, wherein a non-upset portion of the drill pipe adjacent to the reheat coil is air cooled during the re-heating.

3. The process of claim 2, further comprising applying a generally circular air curtain to the pipe end during the re-heating between the second position and the third position of the upsetter device.

4. The process of claim 3, wherein the air curtain supplied by a semi-circular air manifold having a plurality of air orifices spaced about its inner diameter is pressurized with compressed air, wherein the manifold is mounted on a face of the re-heat coil and the air orifices are spaced around the inside diameter of the manifold to deliver a flow of cooling air to the non-upset area of the drill pipe to the auxiliary induction heating coil.

5. A process for forming upsets on a pipe end of a drill pipe, comprising:

preheating the pipe end;

moving the pipe end into a heater to bring the pipe end to a forging temperature of above 2350° F.;

inserting the pipe end into a first position of a pipe upsetter device and cycling the upsetter device on the pipe end a first time;

transporting the pipe to a second position of the pipe upsetter device and cycling the pipe upsetter device to upset the pipe end a second time;

if the drill pipe requires a third upsetting then transporting the pipe end to a reheat coil located between the pipe upsetter device and the primary coil;

re-heating the pipe end to about 2350° F. in the reheat coil; and transporting the drill pipe to a third position of the pipe upsetter device and cycling the upsetter device to upset the pipe end a third time.

6. The process of claim 5, further comprising cooling a non-upset region of the drill pipe adjacent the pipe end while reheating the pipe end in the reheat coil.

7. The process of claim 6, further comprising applying a generally circular air curtain to the pipe end during the re-heating between the second position and the third position of the pipe upsetter device.

8. The process of claim 7, wherein the air curtain supplied by a semi-circular air manifold having a plurality of air orifices spaced about its inner diameter is pressurized with compressed air, wherein the manifold is mounted on a face of the re-heat coil and the air orifices are spaced around the inside diameter of the manifold to deliver a flow of cooling air to the non-upset area of the drill pipe to the auxiliary induction heating coil.

9. The process of claim 7, wherein a robot then transports the drill pipe back into the at least one final die pocket of the upsetter device where the pipe end is forged to its final dimensions.

* * * * *